United States Patent [19]

Kägi

[11] Patent Number: 5,058,365

[45] Date of Patent: Oct. 22, 1991

[54] TENSIONING AND SEALING APPARATUS FOR A STRAP MADE OF PLASTIC

[75] Inventor: Bruno Kägi, Uezwil, Switzerland

[73] Assignee: Strapex AG, Wohlen, Switzerland

[21] Appl. No.: 404,848

[22] Filed: Sep. 8, 1989

[30] Foreign Application Priority Data

Sep. 8, 1988 [CH] Switzerland ..... 03364/88

[51] Int. Cl.[5] ..... B65B 13/22

[52] U.S. Cl. ..... 53/582; 53/589; 53/592; 100/33 PB; 156/495; 156/580

[58] Field of Search ..... 53/582, 587, 588, 589, 53/592, 390; 100/33 PB; 156/73.5, 495, 579, 580

[56] References Cited

U.S. PATENT DOCUMENTS

| | | | |
|---|---|---|---|
| 2,982,069 | 5/1961 | England | 53/592 |
| 3,269,300 | 8/1966 | Billett et al. | 100/33 PB |
| 3,447,447 | 6/1969 | Rutty | 100/33 PB |
| 3,566,778 | 3/1971 | Vilcins | 100/33 PB X |
| 4,050,372 | 9/1977 | Kobiella | 156/73.5 X |
| 4,820,363 | 4/1989 | Fischer | 156/73.5 X |

FOREIGN PATENT DOCUMENTS

| | | |
|---|---|---|
| 187942 | 7/1986 | European Pat. Off. . |
| 188720 | 7/1986 | European Pat. Off. . |
| 284798 | 10/1988 | European Pat. Off. . |

*Primary Examiner*—John Sipos

*Attorney, Agent, or Firm*—Collard, Roe & Galgano

[57] ABSTRACT

A tensioning and sealing apparatus, for tensioning and sealing a strap made of a plastic passed around a packaged item, is disclosed. The apparatus includes a clamping device for securing a lower starting section of a plastic strap. The apparatus of the invention further includes a tensioning device for both tensioning the strap and for acting upon an upper section thereof. Upstream from the tensioning device, a friction welding device is provided which preferably includes two welding dies, which are movable relative to one another, for joining mutually overlapping regions of the strap. A cutting member is further provided, preferably arranged between the friction welding device and the tensioning device, for cutting through the upper section of the strap after the strap has been welded. A clean cut of the strap is accomplished by a strap tension holding device, which acts upon a section of the strap downstream of the friction welding device, after completion of the tensioning operation, which is used for maintaining a residual tensile stress ($\sigma_2$) of the portion of the strap downstream of the welding device. This residual tensile stress ($\sigma_2$) is to be less than the tensile stress ($\sigma_1$) in the plastic strap at the end of the tensioning operation.

23 Claims, 4 Drawing Sheets

TENSIONING AND SEALING APPARATUS FOR A STRAP MADE OF PLASTIC

The present invention relates to an apparatus for tensioning and sealing a strap made of plastic passed around a packaged item.

Heretofore, the prior art has included a tensioning and sealing device wherein after tensioning of the strap, the strap tension is fully maintained during subsequent welding of the mutually overlapping strap ends and the cutting through of the upper strap end by the strap tensioning device. In such device the tensioning wheel is prevented from rotating backwards (European Patent Application No. 0,188,720). There is a risk with this known device that when the upper strap end, which is under great stress, is cut through, a clean cut is not obtained because the plastic strap frays at the cutting edge.

European Patent Application No. 0,284,798 describes a device which is very similar to the abovementioned device in many respects. A difference exists however, in that the tensioned strap is held in front of the friction welding device (as seen in the tensioning direction) after the tensioning operation by a second clamping device which takes over the holding of the strap tension. The tensioning wheel is released by a control mechanism and can rotate backwards counter to the tensioning direction. As a consequence, the upper strap section, extending between the second clamping device and the tensioning wheel, is completely relaxed. As a result, both mutually overlapping strap sections are not subject to a tensile stress, which makes it possible for these strap sections to be mutually laterally displaceable. In such a case, there is then the risk that the upper strap section is not completely cut through by the cutting blade.

It is, therefore, an object of the present invention to provide a tensioning and sealing device for use with a plastic strap which provides a clean cutting through of an upper strap section, on a reliable basis, without damaging the same even when the strap is greatly tensioned.

The foregoing and related objects are achieved by a tensioning and sealing apparatus which includes a clamping device for securing a lower starting section of a plastic strap. The apparatus of the invention further includes a tensioning device for both tensioning the strap and for acting on the upper section thereof. Upstream from the tensioning device, a friction welding device is provided. The welding device preferably includes two welding dies, which are movable relative to one another, for joining mutually overlapping regions of the strap. The apparatus further includes a cutting member, preferably arranged between the friction welding device and the tensioning device, for cutting through the upper section strap after the strap has been welded. Achievement of a clean and reliable cut is accomplished by a strap tension holding device, which acts upon a section of the strap downstream of the friction welding device (when seen in the tensioning direction), after the end of the tensioning operation, which is used for maintaining a residual tensile stress ($\sigma_2$) of the portion of the strap downstream of the welding device. This residual tensile stress ($\sigma_2$) is to be less than the tensile stress ($\sigma_1$) in the plastic strap at the end of the tensioning operation.

Achievement of the object of the present invention is based upon the recognition that it is necessary, before cutting through a strap section, to reduce the strap tension therein without, however, completely removing such strap tension, in order to obtain a perfect cut. The strap section, which is slightly tensioned, can then be cut through completely without difficulty and without the strap ends being destroyed (i.e., ripped) at the cutting point.

For maintaining the tensile stress in the strap passed around the packaged item, it is necessary to provide a second clamping device in which a tensioning wheel, which is provided for tensioning the strap, is released to reduce the strap tension, and is rotated backwards slightly. This measure also confers the additional advantage that the upper strap end is subjected to a certain tensile stress, for the friction welding operation too, which stress, however, is less than the tensile stress prevailing at the end of the tensioning operation.

Further preferred embodiments of the invention are described hereinafter.

The present invention confers added advantages, in particular, when, the tensioning wheel is a slotted wheel which permits a tensioning of a strap with a very great tensile force.

The advantages of providing a strap tension holding device become particularly evident when, in a preferred embodiment of the invention, a blade is provided for cutting through the upper strap section, wherein the blade is moved synchronously, with the welding die driven in a reciprocating manner, transversely to the longitudinal direction of the strap.

Other objects and features of the present invention will become apparent to those skilled in the art when the present invention is considered in view of the accompanying drawing figures. It should, of course, be recognized that the accompanying drawing figures illustrate a preferred embodiment of the present invention and are not intended as means for defining the limits and scope of the present invention.

In the drawing figures, wherein similar reference numerals denote similar features throughout the several views.

Figure 1:
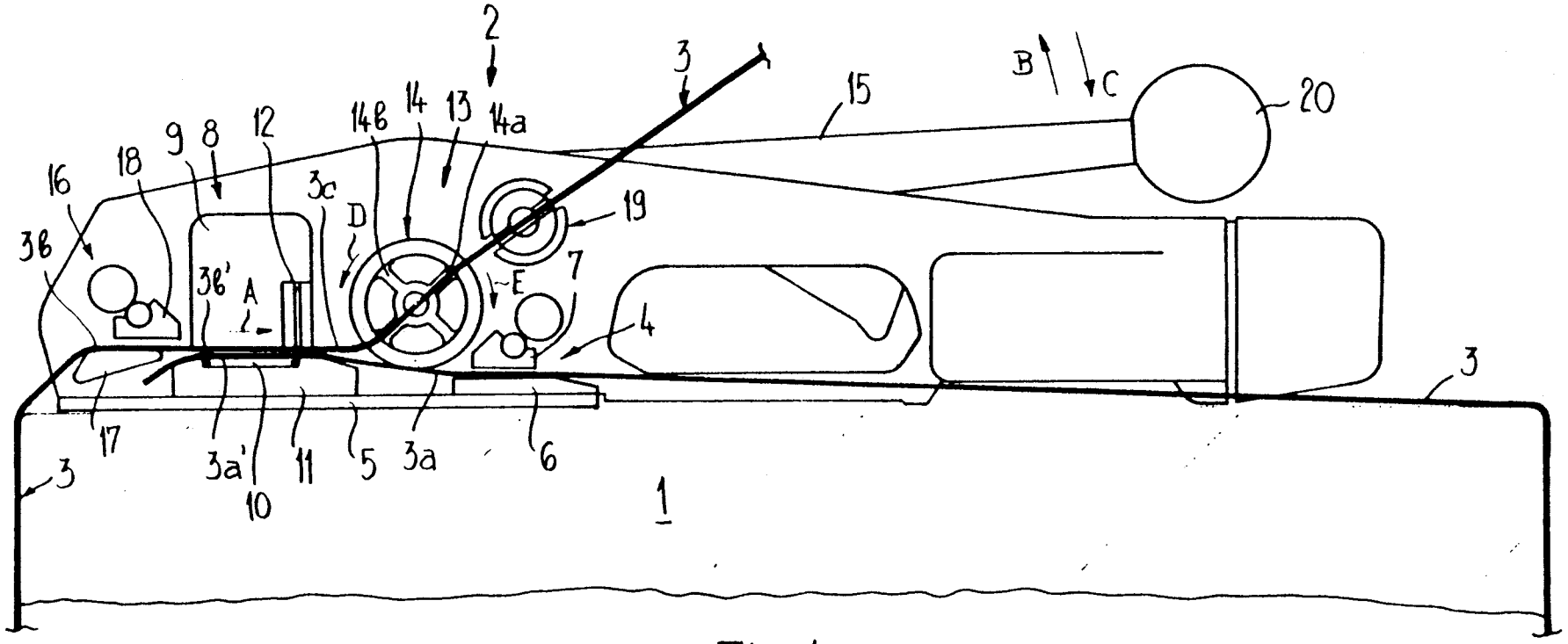
FIG. 1 shows a side view of a tensioning and sealing device placed on a packaged item with an inserted strap.

Turning now, in detail, to the drawing, FIG. 1 shows a side view of a tensioning and sealing device 2, placed on a package 1, which serves to tension and seal a strap 3 made of plastic passed around the package 1. The device 2 has a first clamping device 4 for holding the lower starting section 3*a* of the strap 3. This clamping device 4 includes a bottom clamping element 6 fastened on a baseplate 5 and a movable clamping foot 7. The device 2 is, furthermore, provided with a friction welding device 8 having a top welding die 9 and bottom welding die 10. The top welding die 9 is designed as a clamping stamp which can be raised and lowered. The bottom welding die 10 is mounted in a bearing part 11, fastened to the baseplate 5, and can be driven in a reciprocating manner transversely, with respect to the longitudinal direction of the strap 3, by means of a drive mechanism not shown. The friction welding device 8 and the drive mechanism for the bottom welding die 10 may be constructed in a known manner. Associated with the friction welding device 8 is a cutting blade 12 which serves to sever the upper strap section, 3*b*, following the welding point. This cutting blade 12 can be conventionally driven in a reciprocating manner and synchronously with the bottom welding die 10.

Provided for tensioning the strap 3 is a tensioning device 13, which has a slotted wheel 14 and a tensioning lever 15, as shown in FIG. 1, at its bottom end position. The slotted wheel 14 is provided with two slots (14*a* and 14*b*) standing at right angles to one another for inserting the strap 3. Prior to the friction welding device 8, is a second clamping device 16, having a bottom clamping plate 17 and a clamping foot 18, which can be lowered. Seen in the strap tensioning direction, A, there is arranged, following the slotted wheel 14, a cutting mechanism 19, which serves to cut through the strap 3 running from the tensioning wheel 14 to a magazine roll (not shown), after the end of the sealing operation. The tensioning lever 15 is provided at its free end with a rotary knob 20, by means of which a switch-over device located in the tensioning lever 15 can be actuated; the method of functioning of which will be explained hereinafter.

The construction of the tensioning device and the strap tension holding arrangement will now be explained in greater detail with reference to FIGS. 2–4.

Figure 2:
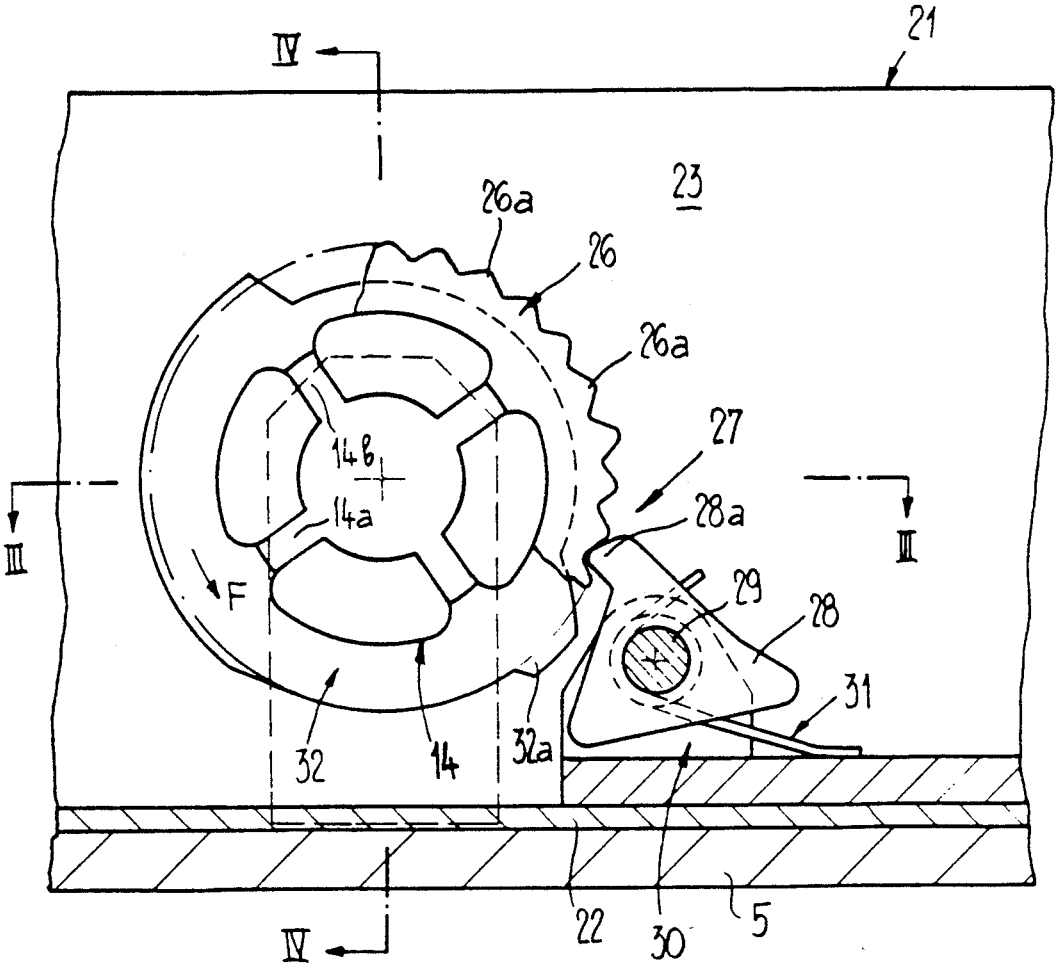
FIG. 2 shows a side view of the region of the tensioning device of the device according to FIG. 1, with various parts thereof being broken away.
Figure 3:
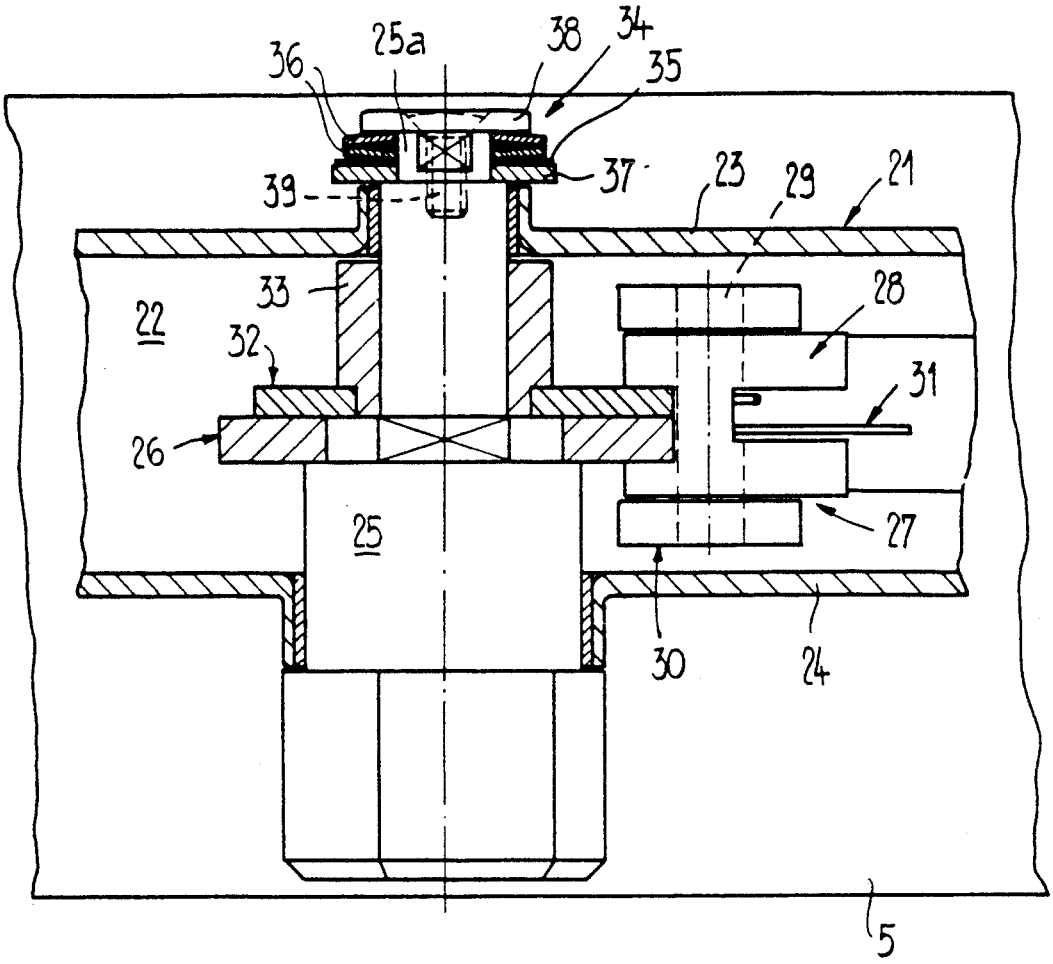
FIG. 3 shows a section taken along line III—III in FIG. 2.
Figure 4:
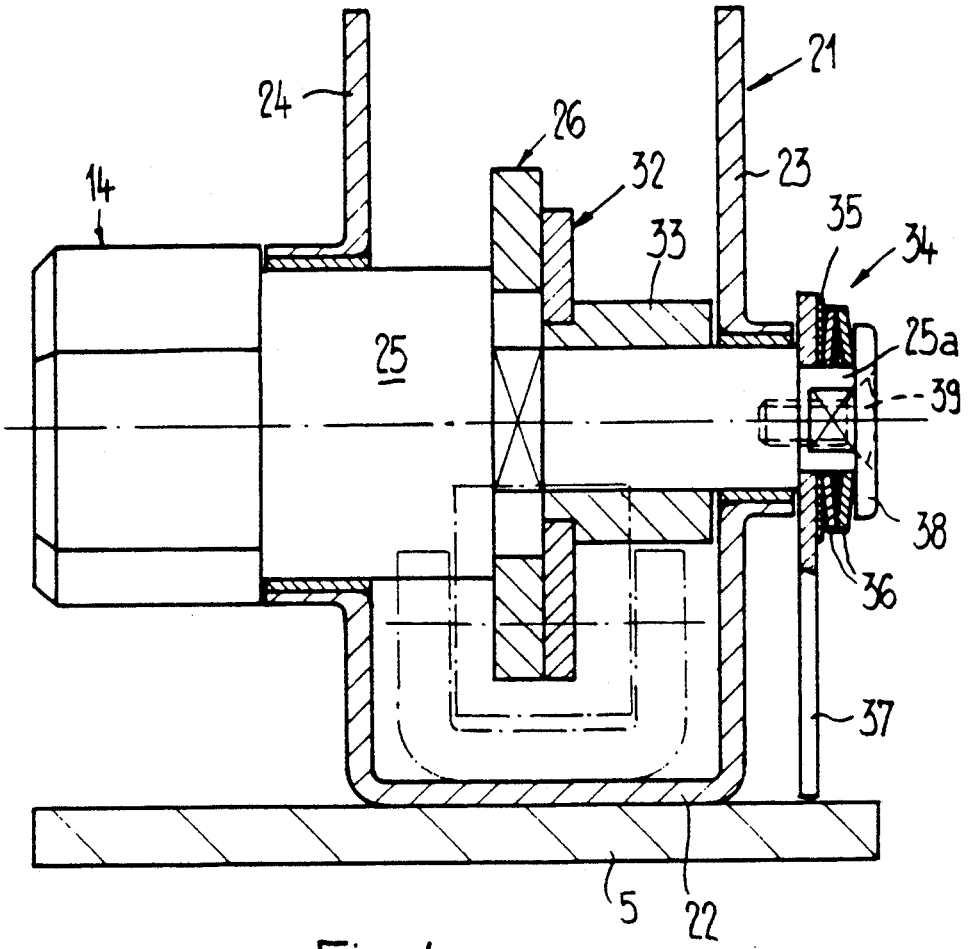
FIG. 4 shows a section taken along the line IV—IV in FIG. 2.

As FIGS. 2–4 illustrate, a U-section 21, which is fastened with its base part 22 to the baseplate 5, stands on the baseplate 5. The side walls 23 and 24 of the U-section 21 serve as bearing plates for a shaft 25, which bears the slotted wheel 14 and a ratchet wheel 26. Slotted wheel 14 and ratchet wheel 26 are fixed on the shaft 25 and can, thus, be rotated with one another. The ratchet wheel 26 forms a part of a locking mechanism 27, which a pawl 28 forms a further part thereof. This pawl 28 is seated pivotably on a spindle 29, which is held in a bearing 30. A leg spring 31, which presses the pawl 28 against the ratchet wheel 26, acts on the pawl 28. As a consequence thereof, a projection 28*a* of the pawl 28 engages between the teeth 26*a* of the ratchet wheel 26 and prevents the latter, and hence also the slotted wheel 14, from rotating backwards in a clockwise direction (arrow E in FIG. 1).

The shaft 25 further bears a cam disk 32 which is attached to a hub 33 which is arranged to be freely rotatable on the shaft 25. The cam disk 32 has a disk cam 32*a* (FIG. 2) which serves to force away the pawl 28, counter to the force of the leg spring 31, and move the projection 28*a* of the pawl 28 out of engagement with the ratchet wheel 26.

Arranged at the end of the shaft 25 opposite the slotted wheel 14 is a brake arrangement 34 designed as a friction brake (FIGS. 3 and 4). This brake arrangement 34 has a brake disk 35, which is forced by means of disk springs 36 against a brake plate 37 anchored at the baseplate 5, rotating together with a prolongation 25*a* of the shaft 25. The disk springs 36 are pretensioned by means of a washer 38 and a screw 39. With this brake arrangement 34, a certain braking torque is exerted on the shaft 25, and hence on the slotted wheel 14, to overcome a correspondingly higher torque, which is generated by forces acting on the slotted wheel 14 or on the ratchet wheel 26.

For turning the ratchet wheel 26 further, and hence for rotating the slotted wheel 14 in a counter-clockwise direction, that is in the direction of arrow D (FIG. 1), a pawl (not shown) is mounted in the tensioning lever 15 which is intended for engaging between the teeth 26*a* of the ratchet wheel 26. The tensioning lever 15 has a second pawl (not shown) which serves for rotating the cam disk 32. In each case one of the two pawls is brought into engagement with the ratchet wheel 26 or with the cam disk 32, by means of the abovementioned switch-over device accommodated in the tensioning lever 15 actuated by rotating the rotary knob 20. The construction and method of operation of a switch-over device as employed in connection with the present invention may be of a conventional construction and operation, as generally known to the art. Additionally, cam disk 32 also serves to lower the top welding die 9 at the beginning of the welding operation.

The clamping device 16 is activated, that is the clamping foot 18 is lowered, after the completion of the tensioning operation by means of the cam disk 32.

The device 2 functions as follows:

The starting section 3*a* of the strap is inserted into the first clamping device, which is thereupon closed. The strap 3 is then laid around the packaged item 1, passed through the open clamping device 16, inserted together with the lower strap section 3*a* between the welding dies 9 and 10 and then inserted into a slot 14*a* of the slotted wheel 14 and into the cutting device 19, as shown in FIG. 1. By swinging up the tensioning lever 15 in the direction of arrow B and by repeated reciprocal movement of the latter, the strap 3 is then tensioned.

After the end of the tensioning operation, the tensioning lever 15 is swung again in the direction of arrow C into the initial position, as shown in FIG. 1, in which the switch-over device is actuated by rotating the rotary knob 20. This switch-over device is used to bring one pawl out of engagement with the ratchet wheel 26, which is prevented from rotating backwards by the pawl 28. Following this, the other pawl is brought into engagement with the cam disk 32, which is then rotated by swinging up the tensioning lever 15 again in the direction of arrow B in a counter-clockwise direction (arrow F in FIG. 2). In the course of this rotation, the cam disk 32 activates the second clamping device 16, which firmly clamps the tensioned strap 3 and holds the strap tension produced by the tensioning device 13.

Figure 5:
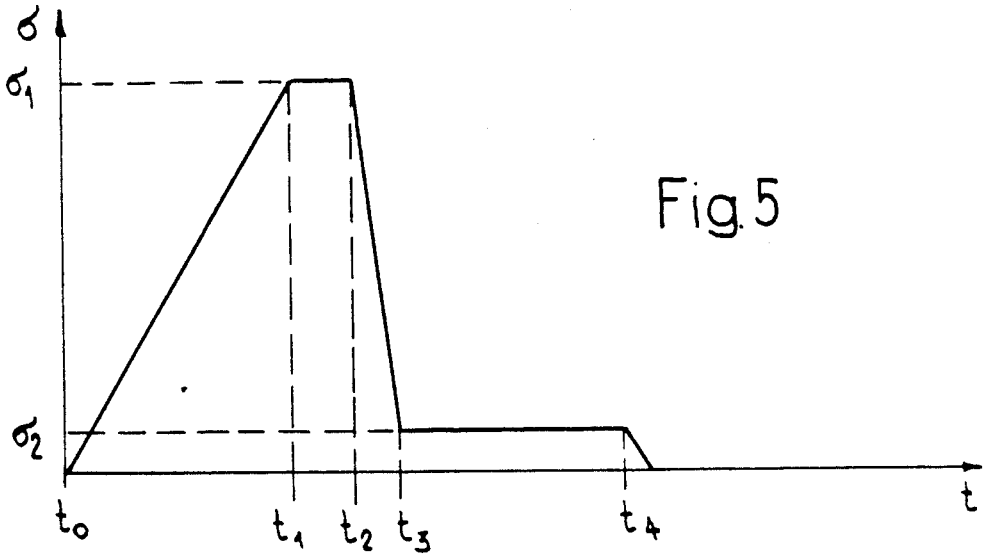
FIG. 5 shows a diagram illustrating the curve of the strap tension during the tensioning and sealing operation.

The curve of tension, $\sigma$, in the strap 3, as a function of the time t, is illustrated in the diagram according to FIG. 5. As can be seen from this diagram, in the interval between instant $t_0$ and $t_1$ there is produced, in the strap 5 by means of the tensioning device 13, a strap tension $\sigma_1$ which is held during interval $t_1$ to $t_2$, firstly by the tensioning wheel 13 and then by the clamping device 16.

When the cam disk 32 is rotated further, its disk cam 32*a* comes to act on the pawl 28, which is thereby brought out of engagement with the ratchet wheel 26. The slotted wheel 14 is thus released for rotation. The tensioning wheel 14, at this point, has rotated backwards in a clockwise direction, i.e., in the direction of arrow E (FIG. 1), by the strap 3, which is under very great tension and is, as already explained, passed through a slot 14*a* of the slotted wheel 14, as a result of which the tensile stress is reduced in the strap section 3*c*, which extends between the slotted wheel 14 and the clamping device 16. This reduction in the strap tension in strap section 3*c* takes place in period $t_2$ to $t_3$ (FIG. 5).

As soon as the restoring torque exerted by the strap 3 on the slotted wheel 14 reaches the value of the braking torque exerted by the brake arrangement 34 on the shaft 25, the slotted wheel 14 is blocked and prevented from a further backwards rotation. This condition is reached at instant $t_3$ (FIG. 5). A residual tensile stress $\sigma_2$ (FIG. 5) remains in strap section 3*c*, which is maintained until the completion of the sealing operation (instant $t_4$). The cam disk 32 rotates slightly further in the direction of arrow F, which results in the top welding die 9 being lowered and the bottom welding die 10 being set in motion. The overlapping regions 3*a*′ and 3*b*′ of the strap 3 are now welded in the friction welding device 8. During the welding operation, cutting through of the upper strap section 3*b* commences with the blade 12 which is, as already mentioned, moved in a reciprocating manner with the bottom welding die 10.

After the end of the welding operation and after the upper strap section 3*b* has been cut through by the blade 12, the tensioning lever 15 is swung back into its bottom end position in the direction of arrow C, as a consequence of which the clamping devices 4 and 16 are released and the top welding die 9 is raised. In addition, the cutting device 19 is actuated in order to sever the strap piece 1, deformed in the region of the slotted wheel 14 from the strap supply. In addition, the slotted wheel 14 is rotated back into its initial position in which a light insertion of the strap 3 is possible for the next tensioning and sealing operation.

Since during the welding and cutting operation the strap piece 3*a*, lying between the slotted wheel 14 and the clamping device 16, is subjected to a certain tension, which is, however, noticeably less than the tensile force acting on the strap 3 at the end of the tensioning operation, a complete cutting through of the upper strap section 3*b* is possible without the strap ends being ripped and frayed at the cutting point.

Instead of the brake arrangement 34, which exerts a certain braking torque on the shaft 25 bearing the slotted wheel 14, other variations of the invention are conceivable which permit a complete backwards rotation of the released slotted wheel 14 under the action of the relaxing strap 3; thus, for example, a stop configuration, which limits the angle of rotation of the slotted wheel 14 when the latter is rotated backwards, which can be switched on and off or overridden.

It is, furthermore, possible to design the strap tension holding device completely separate from the tensioning wheel (e.g., slotted wheel) so that this strap tension holding device does not act via the slotted wheel 14, but rather, for example, directly on the strap section 3*c*.

While only several embodiments of the present invention have been shown and described, it will be obvious to those or ordinary skill in the art that many modifications may be made to the present invention without departing from the spirit and scope thereof.

What is claimed is:

1. Apparatus for tensioning and sealing a strap made of a plastic material around a packaged item, comprising:

a clamping device for securing a lower starting section of the strap;

a tensioning device being adjacent said clamping device and including a tensioning wheel for acting upon an upper section of the strap for a tensioning operation of the strap, the tensioning operation providing a first tensile stress value for the strap;

a second clamping device which is capable of being activated after the tensioning operation for securing the upper section of the strap;

releasing means for releasing said tensioning wheel after activation of said second clamping device;

braking means for acting upon said tensioning wheel, said braking means being activated after a predetermined counter clockwise rotation of said tensioning wheel, following release of said tensioning wheel, in order to prevent said tensioning wheel from undergoing a backward clockwise rotation;

a friction welding device being provided upstream of said tensioning device, said friction welding device having a plurality of welding dies movable relative to one another for joining overlapping regions of the strap;

a cutting member arranged between said friction welding device and said tensioning device for cutting through the upper section of the strap after welding of the strap by said friction welding device; and a strap tension holding device acting upon said tensioning wheel following the tensioning operation for reducing the tensile stress value in the section of the strap downstream of said friction welding device, said second tensile stress value being less than the first tensile stress value determined after the tensioning operation.

2. The apparatus according to claim 1, wherein said braking means includes a locking mechanism coupled to said tensioning wheel for preventing a backward rotation of said tensioning wheel.

3. The apparatus according to claim 2, wherein said locking mechanism includes a ratchet wheel connected rotationally fast to said tensioning wheel, said locking mechanism further including a pawl acting on said ratchet wheel which is releasable by the action of a control member.

4. The apparatus according to claim 3, wherein said control member is a cam disk.

5. The apparatus according to claim 1, wherein said braking means includes a friction brake capable of acting upon a shaft of said tensioning wheel.

6. The apparatus according to claim 5, wherein said friction brake includes at least two brake members abutting one another with a corresponding force wherein one of said brake members sits on the shaft of said tensioning wheel and another of said brake members has a fixed mounting.

7. The apparatus according to claim 1, wherein said tensioning wheel is a slotted wheel with at least one slot capable of receiving said strap.

8. The apparatus according to claim 1, wherein one of said welding dies is a top welding die and acts as a clamping stamp which is capable of being raised or lowered and wherein another of said welding dies is a bottom welding die which is capable of being driven in a reciprocating manner relative to said top welding die.

9. The apparatus according to claim 8, wherein one of said welding dies is capable of being driven transversely relative to a longitudinal direction of the strap, said cutting member having a blade which is movable synchronously with such welding die.

10. The apparatus according to claim 9, wherein said welding die capable of being driven transversely relative to a longitudinal direction of the strap is said bottom welding die.

11. The apparatus according to claim 1, wherein one of said welding dies is a top welding die and acts as a clamping stamp which is capable of being raised or lowered and wherein another of said welding dies is a bottom welding die which is capable of being driven in a reciprocating manner relative to said top welding die.

12. The apparatus according to claim 11, wherein one of said welding dies is capable of being driven transversely relative to a longitudinal direction of the strap, said cutting member having a blade which is movable synchronously with such welding die.

13. The apparatus according to claim 12, wherein said welding die capable of being driven transversely relative to a longitudinal direction of the strap is said bottom welding die.

14. Apparatus for tensioning and sealing a strap made of a plastic material around a packaged item, comprising:

a clamping device for securing a lower starting section of the strap;

a tensioning device being adjacent said clamping device, and including a slotted tensioning wheel with at least one slot capable of receiving said strap, for acting upon an upper section of the strap for a tensioning operation of the strap, the tensioning operation providing a first tensile stress value for the strap;

a friction welding device being provided upstream of said tensioning device, said friction welding device having a plurality of welding dies movable relative to one another for joining overlapping regions of the strap;

a cutting member arranged between said friction welding device and said tensioning device for cutting through the upper section of the strap after welding of the strap by said friction welding device; and, a strap tension holding device acting upon said tensioning wheel following the tensioning operation for reducing the tensile stress value in the section of the strap downstream of said friction welding device, said second tensile stress value being less than the first tensile stress value determined after the tensioning operation.

15. The apparatus according to claim 14, further comprising a second clamping device which is capable of being activated after the tensioning operation for securing the upper section of the strap.

16. The apparatus according to claim 15, further comprising means for releasing said tensioning wheel after activation of said second clamping device.

17. The apparatus according to claim 14, wherein one of said welding dies is a top welding die and acts as a clamping stamp which is capable of being raised or lowered and wherein another of said welding dies is a bottom welding die which is capable of being driven in a reciprocating manner relative to said top welding die.

18. The apparatus according to claim 17, wherein one of said welding dies is capable of being driven transversely relative to a longitudinal direction of the strap, said cutting member having a blade which is movable synchronously with such welding die.

19. The apparatus according to claim 18, wherein said welding die capable of being driven transversely relative to a longitudinal direction of the strap is said bottom welding die.

20. The apparatus according to claim 14, wherein one of said welding dies is a top welding die and acts as a clamping stamp which is capable of being raised or lowered and wherein another of said welding dies is a bottom welding die which is capable of being driven in a reciprocating manner relative to said top welding die.

21. The apparatus according to claim 20, wherein one of said welding dies is capable of being driven transversely relative to a longitudinal direction of the strap, said cutting member having a blade which is movable synchronously with such welding die.

22. The apparatus according to claim 21, wherein said welding die capable of being driven transversely relative to a longitudinal direction of the strap is said bottom welding die.

23. Apparatus for tensioning and sealing a strap made of a plastic material around a packaged item, comprising:

a clamping device for securing a lower starting section of the strap;

a tensioning device being adjacent said clamping device, and including a slotted tensioning wheel with at least one slot capable of receiving said strap, for acting upon an upper section of the strap for a tensioning operation of the strap, the tensioning operation providing a first tensile stress value for the strap;

a friction welding device being provided upstream of said tensioning device, said friction welding device having a plurality of welding dies movable relative to one another for joining overlapping regions of the strap;

a cutting member arranged between said friction welding device and said tensioning device for cutting through the upper section of the strap after welding of the strap by said friction welding device; and, a strap tension holding device being capable of acting upon a section of the strap downstream of said friction welding device following the tensioning operation, said strap tension holding device being capable of maintaining a second tensile stress value in the section of the strap downstream of said friction welding device, said second tensile stress value being less than the first tensile stress value determined after the tensioning operation.

* * * * *